US005987096A

United States Patent [19]

Van Der Borst et al.

[11] Patent Number: 5,987,096

[45] Date of Patent: Nov. 16, 1999

[54] X-RAY TUBE HAVING AN INTERNAL WINDOW SHIELD

[75] Inventors: Johannes Van Der Borst, Eindhoven; Johan W. Stolk, Heerlen, both of Netherlands

[73] Assignee: U.S. Philips Corporation, New York, N.Y.

[21] Appl. No.: 08/984,827

[22] Filed: Dec. 4, 1997

[30] Foreign Application Priority Data

Dec. 6, 1996 [EP] European Pat. Off. ..... 96203458

[51] Int. Cl.[6] ..... H01J 35/00

[52] U.S. Cl. ..... 378/121; 378/140

[58] Field of Search ..... 378/140, 119, 378/121, 161, 137, 138, 113

[56] References Cited

U.S. PATENT DOCUMENTS

| | | | |
|---|---|---|---|
| 2,679,017 | 5/1954 | Rogers et al. | 378/140 |
| 3,018,398 | 1/1962 | Atlee | 378/140 |
| 4,322,653 | 3/1982 | Bader et al. | 378/140 |
| 5,173,612 | 12/1992 | Imai et al. | 250/505.1 |
| 5,206,895 | 4/1993 | Danos | 378/121 |
| 5,515,414 | 5/1996 | Van Enschut et al. | 378/141 |
| 5,578,360 | 11/1996 | Viitanen | 428/138 |
| 5,828,727 | 10/1998 | Schild | 378/140 |

FOREIGN PATENT DOCUMENTS

| | | | |
|---|---|---|---|
| 203877 | 4/1955 | Australia | 378/140 |
| 578639 | 6/1933 | Germany . | |
| 1062826 | 1/1960 | Germany . | |
| WO9618477 | 6/1996 | WIPO . | |

*Primary Examiner*—David P. Porta
*Attorney, Agent, or Firm*—Anne E. Barschall

[57] ABSTRACT

The filament for the emission of the electrons in an X-ray tube inevitably evaporates gradually during operation of the tube. Depending on the location of the filament in the tube, the metal vapor thus released is deposited on the X-ray window of the tube. Consequently, the transmission of the X-ray tube window gradually decreases in the course of the service life of the tube. In order to counteract the deposition of filament material, an edge structure is provided on the inner side of the window; this structure comprises edges which extend perpendicularly to the window surface, and is preferably a honeycomb structure with hexagonal cells. The height of the edges is chosen so that, viewed from the filament, the edge structure forms a shadow zone for the entire X-ray window, so that the metal vapor is deposited on the structure instead of on the window.

7 Claims, 3 Drawing Sheets

X-RAY TUBE HAVING AN INTERNAL WINDOW SHIELD

The invention relates to an X-ray tube provided with:

an anode for emitting X-rays, an X-ray window which is situated opposite the anode so as to allow the X-rays to emanate from the tube, a filament for emitting electrons which, after acceleration, are incident on the anode where they generate the X-rays to be emitted, said filament being situated outside the area extending between the anode and the X-ray window, an edge structure with at least one edge which extends transversely of the X-ray window and is situated in the path between the filament and the inner side of the X-ray window.

An X-ray tube of this kind is known from German Patent No. 1 062 826. The known X-ray tube includes a rotary anode, having a conical anode surface, and a cathode which is arranged opposite the focal spot on the anode surface and includes a filament wire. To the side of the combination formed by the cathode and the anode surface there is provided an X-ray window wherethrough the X-rays generated in the anode surface can emanate.

Because the filament must be heated to a high temperature for the emission of the electrons, it is inevitable that the filament gradually evaporates during operation of the tube, the metal vapor thus released being deposited in the vicinity of the filament wire. In the housing of the known X-ray tube there is provided an edge structure which serves to form shadow zones in the regions where the metal vapor is deposited on the inner side of the housing. The effect of these shadow zones consists in that the electrically conductive regions formed by deposition of the metal vapor are interrupted by the shadow zones, thus reducing the risk of high-voltage breakdowns in the tube. The edge structure provided in the housing of the known X-ray tube is formed by constrictions of the glass housing which are situated adjacent the X-ray window. These constrictions are positioned so that precisely housing regions situated to both sides of the X-ray window remain free from metal deposits.

A problem encountered in X-ray tubes is the fact that the metal vapor from the filament wire is also liable to be deposited on the X-ray window, so that the transmission of the X-ray window gradually deteriorates in the course of the service life time of the X-ray tube. Consequently, the properties of the X-ray tube change during its service life; this is particularly undesirable for X-ray tubes for analytical purposes (i.e. tubes for X-ray diffraction and/or X-ray fluorescence). It is not known for the X-ray tube disclosed in the cited Patent to take steps so as to prevent the deposition of filament material on the X-ray window.

It is an object of the invention to provide an X-ray tube in which the deterioration of the transmission of the X-ray window of an X-ray tube is counteracted.

To this end, the invention is characterized in that, viewed from the filament, the edge structure forms a shadow zone for the entire X-ray window.

The location of the edges in the edge structure is chosen so that not one point on the surface of the X-ray window can be "seen" from any point on the filament. This means that the linearly propagating atoms in the metal vapor from the filament will first come into contact with the edges of the edge structure and be deposited thereon. The inner side of the X-ray window is thus shielded from deposition of filament material.

In an embodiment of the invention, the edge structure is formed by a grid-like structure of edges which is situated in the region between the anode and the X-ray window.

Because, viewed across the surface of the X-ray window, the edges are periodically recurrent, it is not necessary to make the edges very high. It is an advantage that the space required for the edges in the direction perpendicular to the window surface can thus remain limited. This is compatible with the requirement that the distance between the anode and the X-ray window should be as small as possible. The latter requirement relates notably to the desire to position the X-ray focus as near to the object to be irradiated as possible, particularly in the case of analytical tubes.

In a further embodiment of the invention the grid-like structure consists of hexagonal cells. This shape offers an as symmetrical as possible distribution of the edges in the edge structure, so that the shape of these cells is suitably compatible with the round shape of X-ray windows.

In a preferred embodiment of the invention, the grid-like structure is in direct contact with the inner side of the X-ray window.

This step offers the advantage that the grid-like structure serves not only to shield the inner side of the X-ray window, but also has a supporting function for the window. As a result, the construction of the window may be substantially thinner than in the absence of a supporting structure.

It is to be noted that from German Patent No. 578 639 it is known per se to use a grid consisting of hexagonal cells for supporting a window in a tube. However, it concerns a tube for the production of electron beams. That tube is not intended to produce X-rays and the grid does not have the function of shielding against deposition of metal vapors.

In a further embodiment of the invention, the filament is arranged around the anode and has a substantially circular shape.

Using this arrangement of the filament relative to the anode and this shape of the filament, it is achieved that the metal vapor from the filament moves laterally towards the window, so that shielding can readily take place, the advantage of a small distance between anode and X-ray window nevertheless being maintained.

The invention will be described in detail hereinafter with reference to the Figures. Therein FIG. 1 is a cross-sectional view of an X-ray tube of the end-window type for analytical purposes in accordance with the invention;

Figure 1:
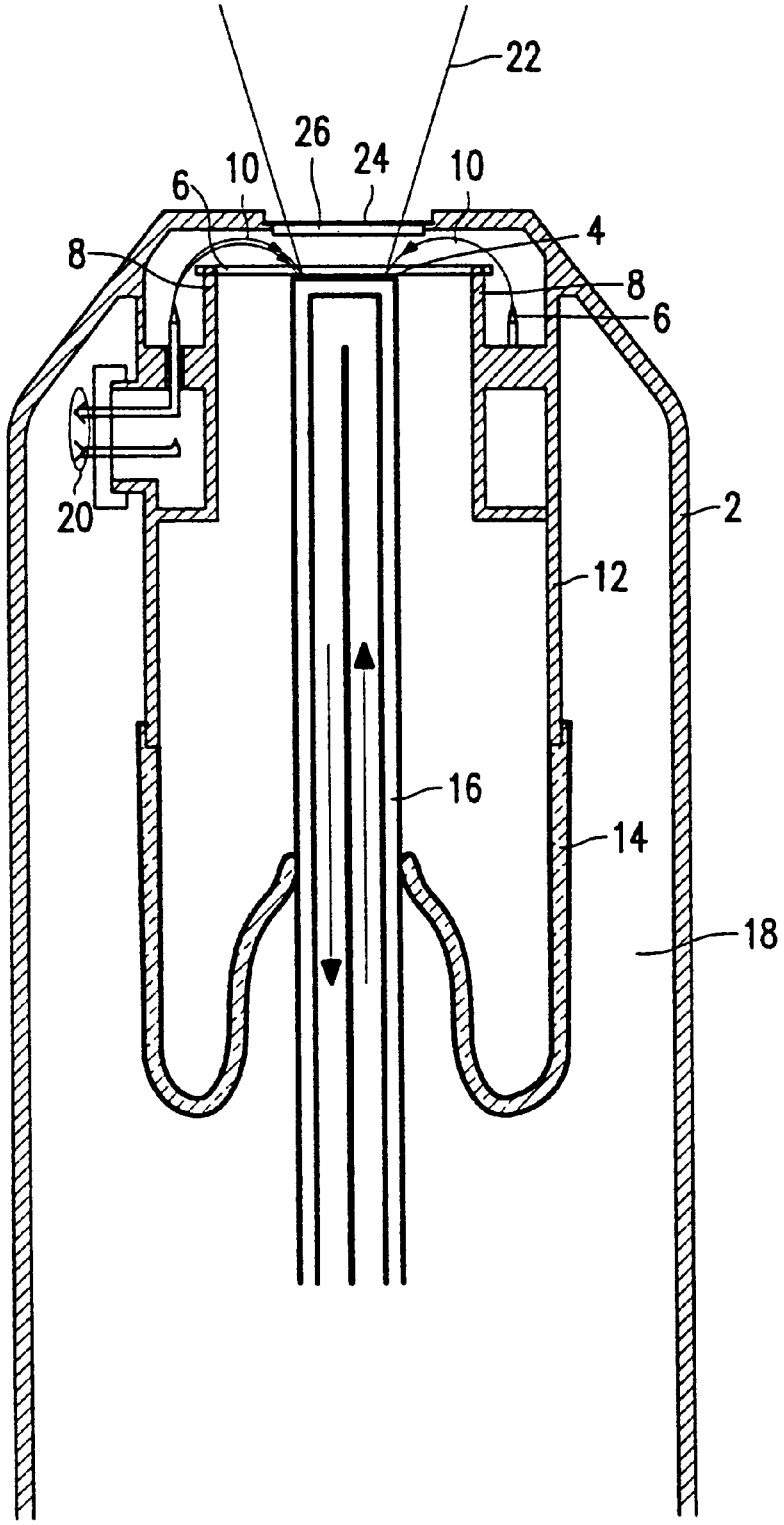

FIG. 1 shows an X-ray tube according to the invention. The X-ray tube is enclosed by a housing 2 in which an anode 4 is arranged. The anode 4 is bombarded by electrons from a cathode device which consists of a filament 6 and a control electrode 8. The electrons released from the filament 6 are directed onto the anode by the control electrode 8 as denoted by the electron beam 10. To this end, the filament 6 is adjusted to a suitable potential relative to the control electrode 8. The control electrode 8 forms part of a supporting construction 12 which is connected to the anode tube 16, via an insulator made of glass or a ceramic material. The anode tube 16 is connected (in a manner not shown in the Figure) to a high-voltage source and is also used for the supply and discharge of a cooling liquid for cooling the anode as denoted by the arrows shown in the anode tube 16. The space 18 around the supporting construction 12 and the insulator 14 is filled with an insulating oil. The filament 6 receives a filament current via terminals 20. The potential of the filament can also be adjusted to the correct value relative to the control electrode 8 via these terminals.

Due to interception of electrons in the anode 4, the anode produces X-rays which emanate from the tube, in the form of an X-ray beam 22, via an X-ray transparent window 24. Windows of this kind are known per se; they are made, for example of beryllium and have a thickness of the order of magnitude of 0.1 mm or less. At the inner side of the window 24 there is provided an edge structure 26 which will be described in detail with reference to FIG. 2.

The X-ray tube is a so-called end-window type in which the anode 4 is arranged as near to the X-ray window 24 as possible. To this end, the filament 6 is arranged around the anode 4 and the electrons emanating from the filament 6 are deflected towards the anode surface by means of the control electrode 8.

Figure 2:
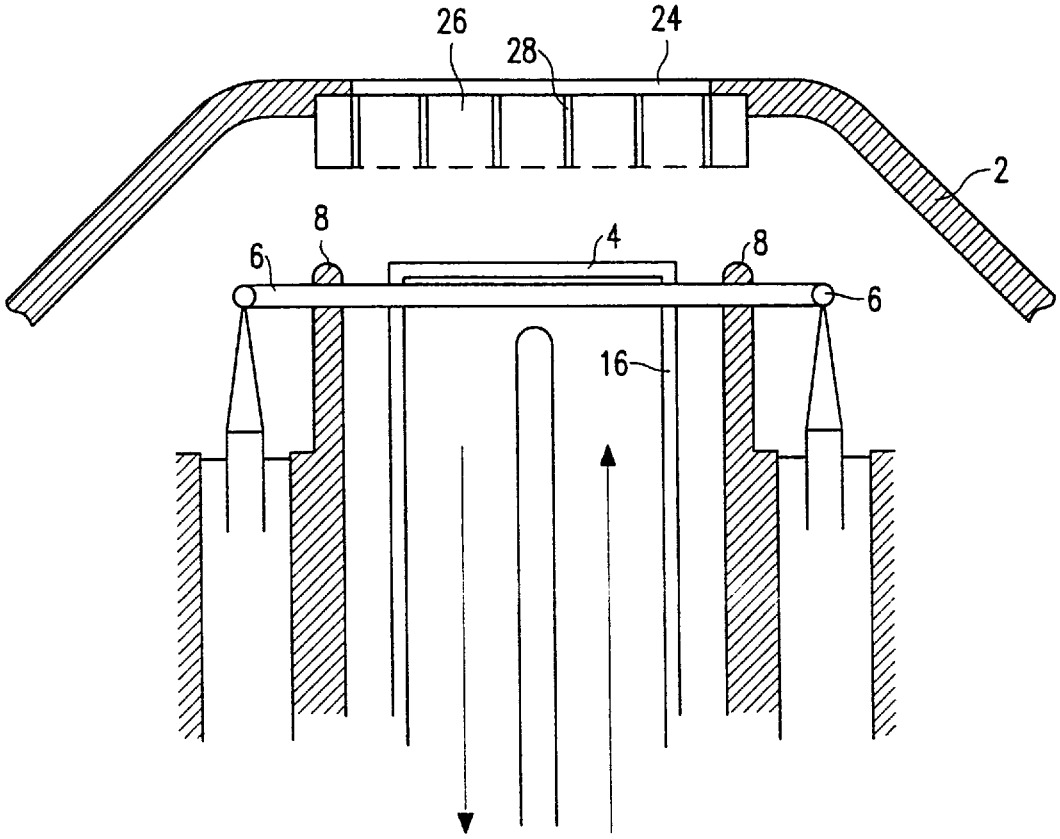
FIG. 2 is a diagrammatic cross-sectional view of a relevant part of the interior of the X-ray tube provided with the edge structure according to the invention.
Figure 3:
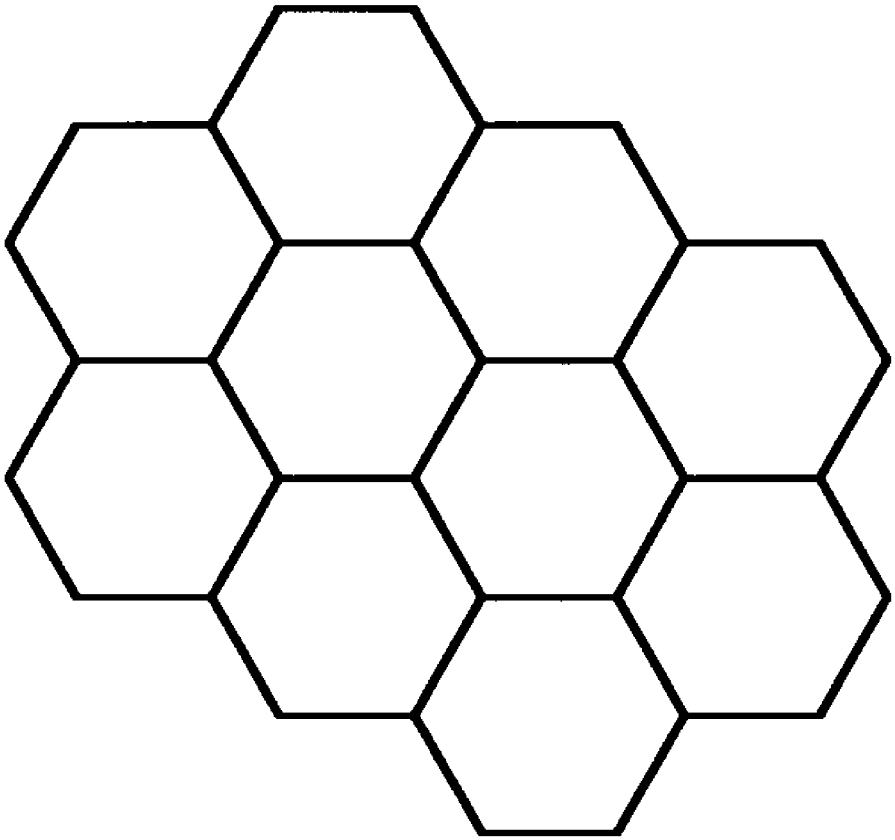
FIG. 3 shows a top view of an embodiment of the edge structure in accordance with the invention.

FIG. 2 is a more detailed representation of the part of the X-ray tube in the vicinity of the X-ray window 24. The edge structure 26 is provided at the inner side of the window 24 and in direct contact therewith. The Figure shows this edge structure as a number of edges 28 which extend perpendicularly to the window surface. These edges may in principle be provided in any configuration, such as a configuration of mutually parallel straight edges, a structure of straight edges which intersect one another at right angles, or a honeycomb structure in which the edges constitute hexagonal cells per FIG. 3. The latter structure is to be preferred. The edges may have a thickness of 0.1 mm whereas their height (i.e. the dimension perpendicular to the window surface) may be 0.5 mm. The diameter of a hexagonal cell may be 0.55 mm. A structure of this kind can be formed, for example as a stack of five plates in which the hexagonal apertures are formed by etching, spark erosion or cutting by means of a laser.

During operation of the X-ray tube the filament is heated so as to release the electrons. Consequently, small quantities of material of the filament (for example, tungsten) evaporate and are deposited on the colder parts of the tube in the vicinity of the filament. If tungsten were deposited on the inner side of the X-ray window 24, this window would gradually become less transparent to X-rays; this would of course be detrimental to the function of this window. Said edge structure in the form of a honeycomb structure with hexagonal cells is provided in order to prevent deposition of tungsten on the window surface. Viewed from the filament, this edge structure constitutes a shadow zone for the entire X-ray window so that metal particles which emanate from the filament and propagate linearly cannot reach the window surface.

The window 24 should be sufficiently strong to withstand the force caused by the atmospheric pressure outside the evacuated tube. Because the edge structure 26 is in direct contact with the window surface, this structure can also perform a supporting function so that mechanical strength of the X-ray window does not impose or hardly imposes a restriction as regards the thickness of the window.

We claim:

1. An X-ray tube provided with:

an anode (4) for emitting X-rays (22), an X-ray window (24) which is situated opposite the anode so as to allow the X-rays (22) to emanate from the tube, a filament (6) for emitting electrons (10) which, after acceleration, are incident on the anode where they generate the X-rays to be emitted, said filament being situated outside the area extending between the anode and the X-ray window, an edge structure (26) with at least one edge (28) which extends transversely of the X-ray window and is situated in the path between the filament and the inner side of the X-ray windows, characterized in that, viewed from the filament, the edge structure forms a shadow zone for the entire X-ray window; and the edge structure is formed by a grid-like structure of edges which is situated in the region between the anode and the X-ray window.

2. An X-ray tube as claimed in claim 1 in which the grid-like structure consists of hexagonal cells.

3. An X-ray tube as claimed in claim 1 in which the grid-like structure is in direct contact with the inner side of the X-ray window.

4. An X-ray tube as claimed in claim 2 in which the filament is arranged around the anode and has a substantially circular shape.

5. An X-ray tube as claimed in claim 2 in which the grid-like structure is in direct contact with the inner side of the X-ray window.

6. An X-ray tube as claimed in claim 3 in which the filament is arranged around the anode and has a substantially circular shape.

7. An X-ray tube as claimed in claim 5 in which the filament is arranged around the anode and has a substantially circular shape.

* * * * *